US006932038B2

(12) United States Patent
Pierik

(10) Patent No.: US 6,932,038 B2
(45) Date of Patent: Aug. 23, 2005

(54) METHOD AND APPARATUS FOR ACTUATING A CAM PHASER

(75) Inventor: Ronald J. Pierik, Rochester, NY (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 10/957,497

(22) Filed: Oct. 1, 2004

(65) Prior Publication Data

US 2005/0039713 A1 Feb. 24, 2005

Related U.S. Application Data

(63) Continuation of application No. 10/447,360, filed on May 29, 2003, now Pat. No. 6,799,544.

(51) Int. Cl.[7] ..... F01L 1/34

(52) U.S. Cl. ..... 123/90.17; 123/90.15; 123/90.27; 123/90.31

(58) Field of Search ..... 123/90.15, 90.17, 123/90.16, 90.18, 90.27, 90.31

(56) References Cited

U.S. PATENT DOCUMENTS 5,117,784 A 6/1992 Schechter et al.
5,337,711 A 8/1994 Hampton
6,453,859 B1 * 9/2002 Smith et al. ..... 123/90.17
6,532,921 B2 3/2003 Sato et al.
6,799,544 B1 * 10/2004 Pierik ..... 123/90.17

* cited by examiner

*Primary Examiner*—Thomas Denion
*Assistant Examiner*—Ching Chang
(74) *Attorney, Agent, or Firm*—Patrick M. Griffin

(57) ABSTRACT

A camshaft phaser wherein camshaft oscillatory torque resulting from opening and closing of an associated engine valve is employed to controllably adjust the degree of advance or retard of the rotor. All advance chambers communicate with a first annular passage, and all retard chambers communicate with a second annular passage. Valve means connecting the first and second annular passages are controllable by a solenoid-actuated piston to permit selective flow of oil between the advance and retard chambers to alter the angular position of the rotor with respect to the stator. The solenoid windings are selectively actuable in response to an engine control module. Preferably, the phaser is a sealed unit, filled with oil at manufacture and requires no oil connection with the oil recirculation system of an engine upon which the phaser is mounted. The phaser is independent of engine oil pressure for actuation.

1 Claim, 4 Drawing Sheets

METHOD AND APPARATUS FOR ACTUATING A CAM PHASER

CROSS REFERENCE TO RELATED APPLICATION

The present application is a continuation application of U.S. application Ser. No. 10/447,360 filed on May 29, 2003, now U.S. Pat. No. 6,799,544.

TECHNICAL FIELD

The present invention relates to camshaft phasers for internal combustion engines; more particularly, to means for controlling the actuation of such camshaft phasers; and most particularly, to method and apparatus for controlling such actuation through camshaft oscillatory torque.

BACKGROUND OF THE INVENTION

Camshaft phasers for varying the valve timing of internal combustion engines are well known. A phaser typically comprises a rotor element that is attached to the end of a camshaft and is variably displaceable rotationally within a stator element driven by the engine crankshaft. Prior art phasers typically are actuated by pressurized oil that is derived from the engine's main oil supply and is selectively directed by electrically-controlled valving to chambers within the phaser to alter the phase relationship between the rotor and stator, and, hence, between the camshaft and crankshaft. Providing oil from the engine can require extensive and undesirable modification of the engine block and/or the camshaft and/or the forward camshaft bearing. Such modifications can be expensive and difficult to implement and are known to be important considerations when adapting a camshaft phaser to an existing engine design. It is highly desirable, therefore, in the art to provide a camshaft phaser requiring little or no modification to the receiving engine.

Further, prior art phasers experience a delay in oil pressure and flow upon start-up of a phaser-equipped engine, which prevents immediate phaser operation. To prevent uncontrolled phaser motion during this delay, vane phasers typically are equipped with additional locking devices to prevent rotor movement. Further, engine oil pressure decreases significantly for hot idle conditions, limiting phaser response rate. Further, oil quality and air entrainment may vary with time and operating conditions, which can also affect phaser torsional stiffness, resulting in unwanted holding position variation. Further, oil viscosity may vary over several orders of magnitude within the normal range of engine operating temperatures, causing a temperature-dependent variation in phaser response rate. And finally, it is difficult to achieve phase change rates greater than about 100 crank degree/second with engine-oil motivated phasers; faster phaser rates require significantly larger engine oil pumps, larger oil flow passages, and higher system pressures. Such changes are expensive in manufacture and adversely affect fuel economy.

A typical cam phaser in good working order exhibits a characteristic level of torque-imposed instability as a result, in part, of the rotor of the cam phaser being mounted directly to the engine camshaft. In opening an engine valve, the valve follower leaves the base circle portion of the cam lobe and begins to climb the rising edge of the eccentric portion, imposing a resistive (negative) torque on the camshaft. At some further position of the cam rotation, the resistive torque reaches a maximum, then declines to zero, and then becomes an assistive (positive) torque in the opposite direction as the follower descends the falling edge of the eccentric portion as the valve closes. Thus, for each rotation of the camshaft lobe, an oscillatory torque is imposed on the camshaft. For a multiple cylinder engine, this cycle is repeated several times for each revolution of the camshaft.

U.S. Pat. No. 6,453,859 B1 discloses a multi-mode control system for variable camshaft devices wherein torque-induced phaser oscillatory motion is employed for providing pressurized engine oil and/or phaser chamber oil to the advance and retard chambers of the phaser via a spool valve. A first drawback of the invention is that an engine oil supply is still required for actuation of the phaser, requiring modification of the associated engine block or head. A second drawback is that an adequate spool valve is relatively cumbersome and therefore has a relatively low reaction rate. A third drawback is that the system requires both a spool valve and a plurality of check valves, as does the apparatus disclosed in U.S. Pat. No. 5,645,017.

What is needed is method and apparatus for controlling actuation of a camshaft phaser without reliance on engine oil supply or pressure.

What is further needed is such method and apparatus wherein flow-controlling check valves are directly actuated without resort to an additional spool valve.

It is a principal object of the present invention to provide actuation control of a camshaft phaser without reliance on engine oil supply or pressure.

It is a further object of the present invention to provide a camshaft phaser which may be installed into an existing engine without a requirement for a real-time supply of engine oil to actuate the phaser.

It is a still further object of the invention to provide a camshaft phaser wherein flow-controlling check valves are directly actuated by a solenoid without requiring an additional spool valve.

It is a still further object of the invention to provide an improved camshaft phaser wherein inherent oil pressure differences within a stator are harnessed to alter the rotational position of a rotor within the stator.

SUMMARY OF THE INVENTION

For simplicity, in the discussion herein below, only vane-type phasers are addressed specifically. However, principles in accordance with the invention for controlling the advance and retard positions of a camshaft phaser should be understood as being applicable by one of ordinary skill in the art to either vane-type or spline-type phasers.

Briefly described, a camshaft phaser includes a conventional stator having a generally cylindrical shape and having a plurality of angularly spaced-apart radial lobes extending inwardly into a central chamber. The stator is adapted to be driven rotationally by the crankshaft assembly of an internal combustion engine. Concentrically disposed within the central chamber of the stator is a rotor having a plurality of radial vanes extending outwardly from a central hub, the vanes being interspersed with the lobes such that first and second chambers are formed on either side of each vane. All first and second chambers are filled with oil. When either the first or second chambers becomes biasedly pressurized, as by oscillatory camshaft torque, for example, the rotor is urged angularly in either a first rotational direction or an opposite second rotational direction within the stator. All first chambers mutually communicate with a first annular passage, preferably formed in an insert disposed in a central assembly bolt therein, and all second chambers mutually communicate with a similarly-disposed second annular passage. Valve means connecting the first and second annular passages are directly actuable by a solenoid-actuated piston to permit selective flow of oil between the first and second chambers to alter the angular position of the rotor with respect to the stator. Rotational torque of the rotor by oscillatory actuating torque resulting from opening and closing actuation of an associated engine valve provides the force for displacing oil from the first to the second chambers or from the second to the first chambers, as desired, to advance or retard the rotor position within the stator. Preferably, the solenoid is selectively actuable in response to an electronic control module that integrates various programmed engine status parameters to permit flow directly between the first and second chambers.

In a currently preferred embodiment, the phaser is a sealed unit, filled with oil at manufacture and requiring no oil connection with the oil recirculation system of an engine upon which the phaser is mounted. In an alternative embodiment, a small flow of oil may be provided to the phaser from the engine to flush out any particles which may form with use, to purge bubbles, and to compensate for any leaks in the phaser. However, in no embodiment in accordance with the present invention is the phaser dependent upon engine oil pressure for actuation, as in prior art phasers.

BRIEF DESCRIPTION OF THE DRAWINGS

The present invention will now be described, by way of example, with reference to the accompanying drawings, in which.

DESCRIPTION OF THE PREFERRED EMBODIMENTS

Figure 1:
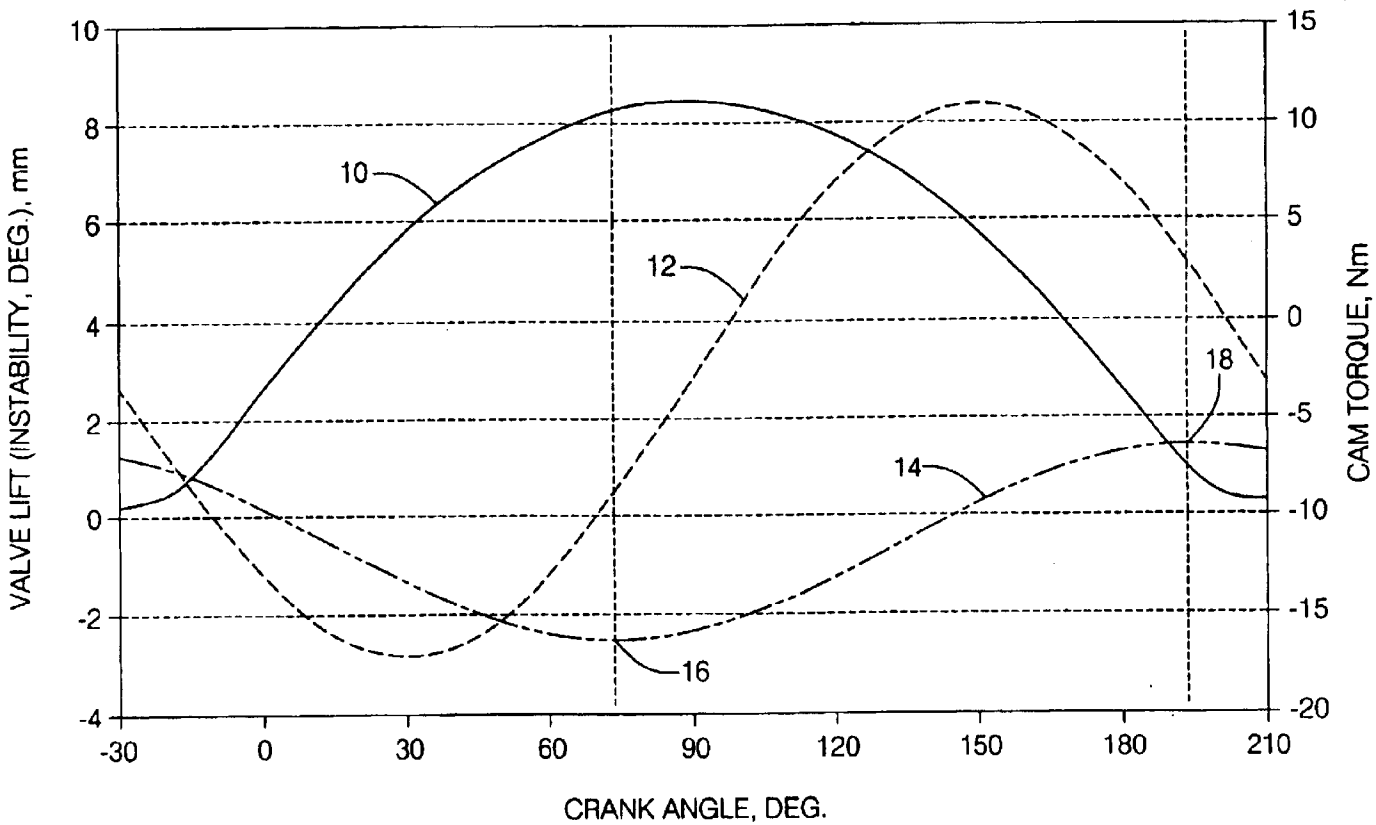
FIG. 1 is a graphical representation of the variation in valve opening distance, oscillatory variation in camshaft torque, and resulting variation in camshaft torque instability as a function of engine crankshaft angle.

Referring to FIG. 1, several simultaneous engine functions are shown as a function of the rotation of an engine crankshaft coupled to an engine camshaft via an improved camshaft phaser assembly in accordance with the invention. Exemplarily, the camshaft functions shown in FIG. 1 relate to a three-lobe intake valve camshaft for one bank of a V-6 engine. Recall that in a four-stroke engine, the crankshaft rotates twice for each rotation of the camshaft; thus, in the example shown, each lobe has an actuation domain of 240 crank angle degrees.

Curve 10 shows the lift in millimeters of a typical engine valve through opening and closing by a cam lobe. Curve 12 shows the torque in Newton-meters imposed on a camshaft by actuation of the valve cam follower for the cam lobe. Note that the initial torque value is negative (counter to camshaft rotation) as the follower begins to ascend the opening flank of the lobe, reaching a minimum of approximately −17 Nm when the valve is about half-open; then becomes increasingly positive (in the direction of camshaft rotation), passing through 0 just ahead of the peak opening of the valve; reaches a maximum value in excess of +10 Nm when the follower is descending the closing flank of the lobe and the valve is about half-closed; and remains positive through the remainder of the valve cycle until the follower is once again on the base circle portion of the cam lobe.

The alternating negative and positive torque exerted on the camshaft causes a slight oscillatory instability in the instantaneous angular position of the rotor during valve actuation by a cam lobe, as shown in curve 14 in FIG. 1 wherein instability is expressed in angular deviation from nominal (0) during actuation by a single lobe. For the three-lobe camshaft described above, such oscillatory instability occurs identically three times with each rotation of the camshaft/rotor. The nominal position is the angular holding position of the phaser rotor with respect to the phaser stator as intended by the phaser electronic control system. In the example shown, the instability curve 14 nearly mirrors the valve opening curve 10, reaching a minimum value 16 of about −2.5 degrees near the valve opening peak and a maximum value 18 of about +1.5 degrees when the valve is nearly closed again. Such oscillatory instability of the rotor is to be expected and is used advantageously in accordance with the invention to controllably adjust the angular position of a rotor within a stator, and hence the advance or retard position of valve timing in an associated internal combustion engine.

Figure 2:
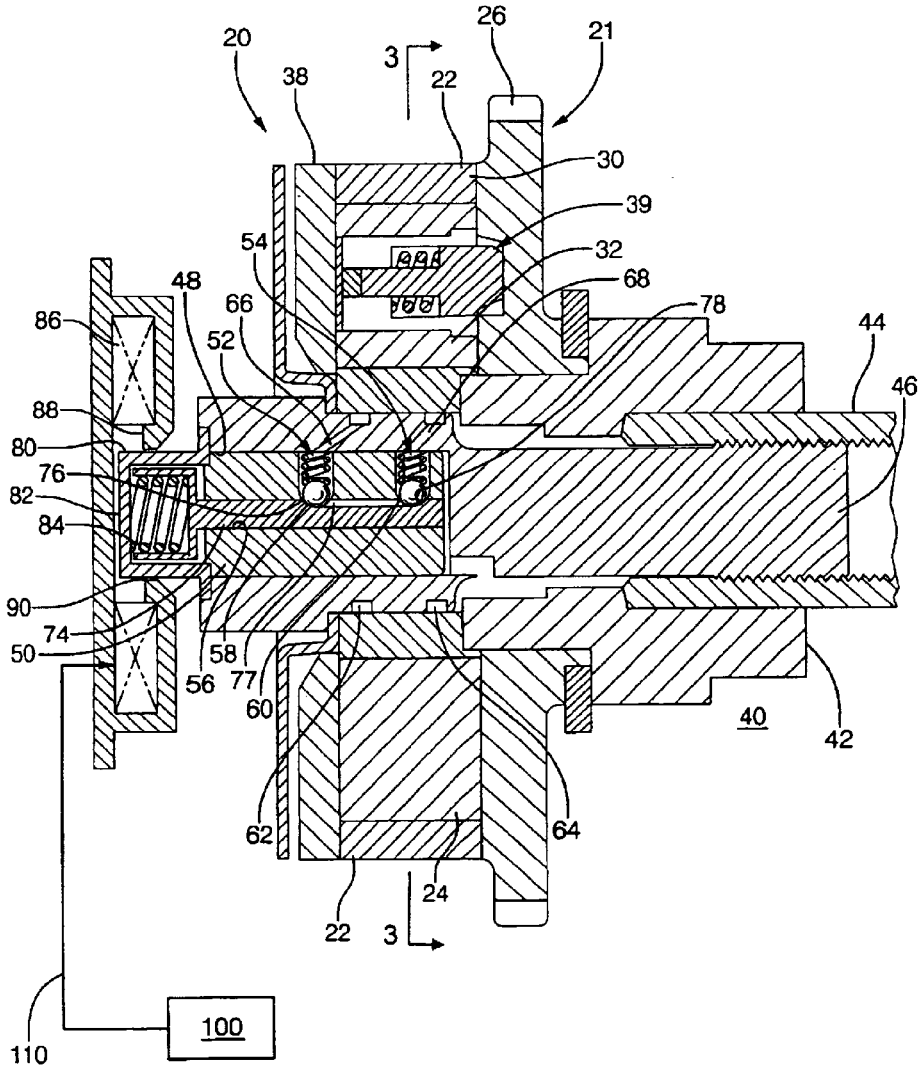
FIG. 2 is an elevational cross-sectional view of a currently preferred first embodiment of a camshaft phaser in accordance with the invention.
Figure 3:
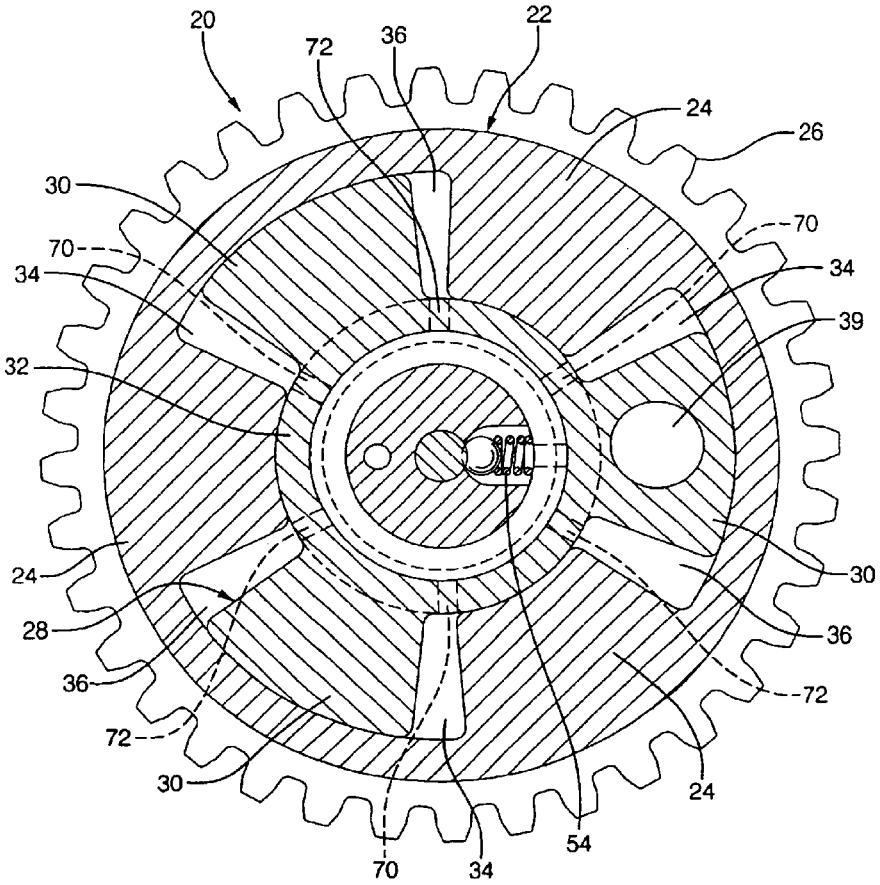
FIG. 3 is a cross-sectional view of the phaser shown in FIG. 2, taken along line 3—3 therein.

Referring to FIGS. 2 and 3, an improved and currently preferred embodiment of a camshaft phaser system 20 in accordance with the invention includes a conventional camshaft phaser 21 having a stator 22 having a generally cylindrical shape and having a plurality of angularly spaced-apart radial lobes 24 extending inwardly. Stator 22 is adapted to be driven rotationally by the crankshaft assembly (not shown) of an internal combustion engine 40 via a conventional sprocket wheel 26. Concentrically disposed within stator 22 is a rotor 28 having a plurality of conventional radial vanes 30 extending outwardly from a central hub 32, vanes 30 being interspersed with lobes 24 such that conventional first and second chambers 34,36 are formed on either side of each vane 30 for either advancing or retarding the position of the rotor with respect to the stator. Chambers 34,36 are closed axially by sprocket wheel 26 and cover plate 38. All first and second chambers 34,36 are filled with oil. Phaser assembly 21 may optionally include a locking pin subassembly 39 disposed in a vane 30 for rotationally immobilizing the rotor with respect to the stator at a specific predetermined relative angle, for example, full retard of the valve timing.

In internal combustion engine 40, a camshaft bearing 42 supports a conventional camshaft 44. Bearing 42 extends beyond engine 40 for also supporting sprocket wheel 26 and rotor hub 32. Camshaft 44 is hollow at its outer end and is threaded for receiving phaser assembly bolt 46. Rotor 28 is fixed to an end of and rotates with camshaft 44 via assembly bolt 46. Thus, lobes on camshaft 44 operate to open and close respective engine valves (not shown).

Bolt 46 is provided with a well 48 for receiving a valving insert 50. Insert 50 includes first and second check valves 52,54 opening into a central bore 56, which valves, when selectively opened as described below, permit unidirectional flow of oil in either of two opposite directions between first and second chambers 34,36.

Check valves 52,54 are disposed in insert 50 such that first and second valve balls 58,60 extend into central bore 56 when the valves are fully closed. Bolt 46 is provided with first and second annular passages 62,64 spaced apart axially and communicating with valves 52,54 via passages 66,68, respectively. First passage 62 communicates with each first chamber 34 via radial passages 70 in hub 32 (FIG. 3). Second passage 64 communicates with each second chamber 36 via radial passages 72 in hub 32.

A piston 74 slidably disposed in central bore 56 includes connector channel 77, and first and second ramps 76,78 for selectively engaging first and second balls 58,60, respectively. Piston 74 is preferably connected to and is axially positionable by a solenoid armature 80 disposed within a non-ferromagnetic cap 82 sealably attached to bolt 46. A solenoid spring 84 is disposed, preferably in compression, between armature 80 and cap 82 to urge armature 80 and piston 74 to the right in FIG. 2. Solenoid windings 86 and primary pole piece 88 surround armature 80 and are mounted on a phaser cover or other non-rotational surface. An air gap 90 exists between pole piece 88 and cap 82 such that, when electrically energized, the solenoid windings are magnetically coupled to the armature through cap 82.

In operation, when either the first or second chambers become biasedly pressurized by oscillatory torque, the rotor is urged angularly in either a first rotational direction or an opposite second rotational direction within the stator, as described above. When a change in rotor position is needed, such as retarding or advancing of the rotor as may be desired for a specific application, ECM 100 controls the voltage and current sent to windings 86, as required. As for example, in a first direction change of the angular position of the rotor, voltage and current to the solenoid windings are turned off causing the magnetic field around the solenoid to collapse, and the magnetic force imposed in the armature to dissipate. The force of spring 84 pushing the armature and piston remains and slides piston 74 to a position such that ramp 76 displaces ball 58, opening check valve 52. In this condition, torque instability creates oscillatory pressure to displace oil from first chambers 34 through opened valve 52 and channel 77, and back through valve 54 (after unseating ball 60 against its bias spring) into second chambers 36. With the completion of one or a few oscillatory cycles, the rotor is driven to its desired angular position. Piston 74 then returns to its neutral position via a signal from ECM 100 whereby both valves 52 and 54 are permitted to close.

When a second rotor position change is desired, the solenoid windings 86 and armature 80 are actuated axially by ECM 100 to engage second ramp 78 with second ball 60, thus allowing oil to flow in a reverse direction from second chambers 36 into first chambers 34 under pressure from oscillatory torque during the opposite phase of the torque cycle. Again, the completion of one or a few oscillatory cycles may be required to provide a sufficient number of successive torque pulses to move the rotor through a sufficient angle. The torque oscillation is rectified during this time so that back flow of oil cannot occur through the positive portion of the oscillation because check valve 52 is closed to flow in that direction.

First and second ramps 76,78 are spaced apart axially such that both first and second check valves 52,54 may be closed simultaneously, effectively locking the rotor in a predetermined, desired holding position of advance/retard. A Pulse Width Modulated (PWM) voltage signal applied by the ECM to the solenoid actuator in known fashion can readily control the piston at such an intermediate position.

With both check valves closed while piston 74 is in an intermediate position, the phaser is hydraulically stiffer than prior art vane-type camshaft phasers because the ratio of vane area to trapped oil chamber volume is relatively large. Conversely, conventional cam phasers having a control valve located within the engine cylinder head have a much larger trapped oil volume and therefore have a greater positional fluctuation for a given torque fluctuation. Since the present improved phaser is significantly stiffer than prior art phasers, a prior art lock pin assembly 39 used to hold the rotor in a predetermined angular position may be eliminated in some applications.

Figure 4:
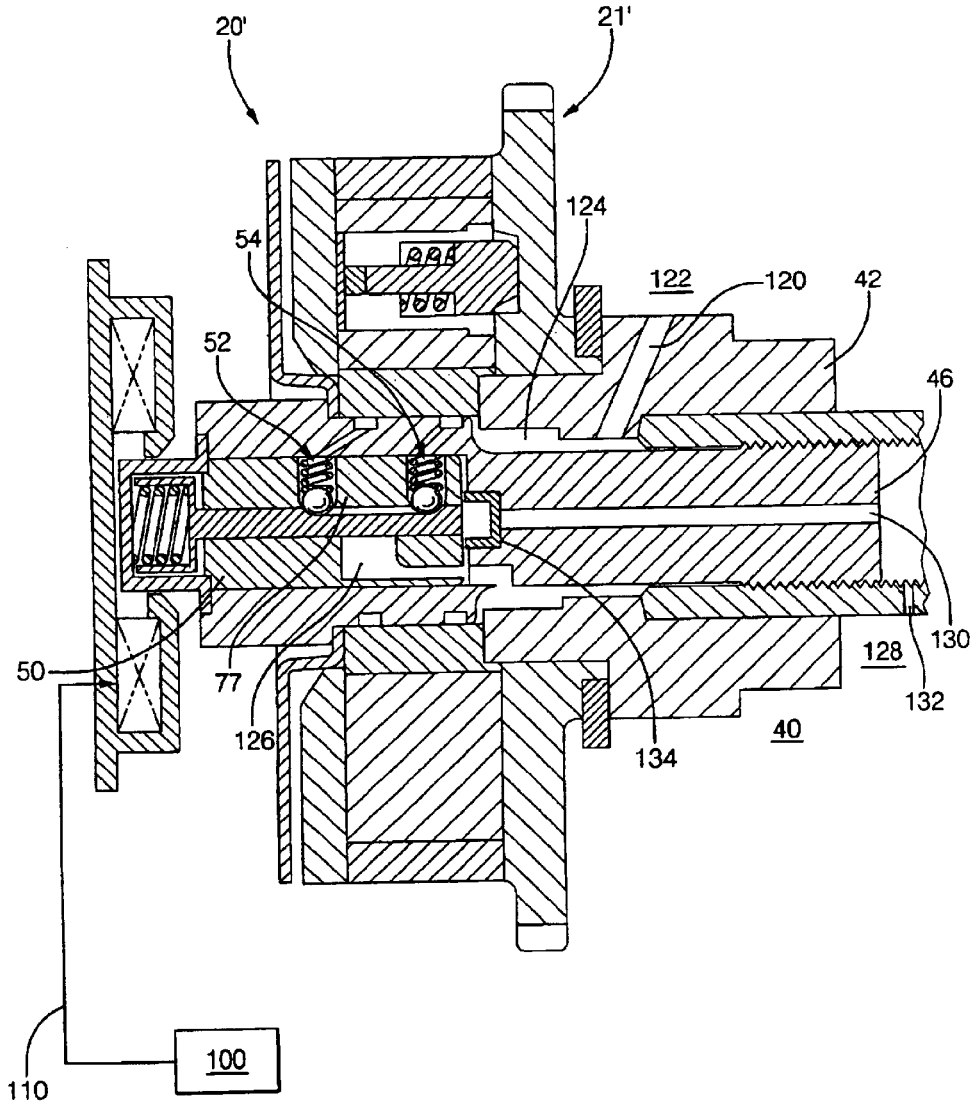
FIG. 4 is a second embodiment of a camshaft phaser in accordance with the invention.

Referring to FIG. 4, in a second embodiment 20' of a phaser system having camshaft phaser 21' in accordance with the invention, engine oil is shown being provided into and out of the phaser assembly, which is otherwise identical to first embodiment 20. An oil feed passage 120 through camshaft bearing 42 connects an oil gallery 122 in engine 40 with an annular reservoir 124 between bearing 42 and bolt 46. Reservoir 124 communicates with a passage 126 in insert 50 for supplying oil as needed to check valves 52,54. Oil returns to an engine sump 128 via a central passage 130 in bolt 46 and a weep hole 132 in camshaft 44. Preferably, the rate of oil flow is very low, being restricted by a restriction orifice 134. Where strict engine oil independence is a requirement, as may be imposed for a specific application, the oil supply and drain passages shown in FIG. 4 may be eliminated, as shown in currently-preferred phaser assembly 20 in FIG. 2. However, there are some positive attributes to accessing engine oil, such as for purging bubbles from the phaser, enabling constant changing and renewing of oil within the phaser so that contaminants are purged, enabling lock pin disengagement by oil pressure, and the like. As noted above, however, in no instance is engine oil pressure the actuating force for rotation of the rotor, as in prior art phasers.

The actuation method disclosed hereinabove employs a magnetic field generated in a solenoid coil mounted in a timing chain cover. There is no mechanical contact between this coil and the rotating phaser, only a magnetic coupling, allowing the phaser to be oil-tight with no actuator sliding or rotating seals, as may be desired for some applications such as belt-driven engines. However, this is only one actuation embodiment. Another embodiment (not shown) includes an electromagnetic coil connected to the piston via a rotatable coupling. Yet another embodiment (not shown) includes the activation coil within the phaser so that it also rotates with the phaser. The electrical signal to the coil is supplied through slip-rings similar to those used for conventional alternators. In a further embodiment (not shown), one coil may be employed per check valve, defining each check valve as a directly-actuated solenoid check valve similar to an engine fuel injector. These may be relatively small coils, since the force they provide must move only the ball in the check valve.

While ramps 76 and 78 are shown as positioned to the outside of check balls 58, 60, it is understood that the ramps may be positioned to the inside of the check balls to reverse the operation of piston 74 relative to the direction of oil flow through valves 52, 54. Means for connecting the fluid flow between the valves, such as for example a longitudinal flute, would also be provided.

The mechanical adaptations required for these embodiments would be obvious to one of ordinary skill in the art and need not be elaborated here. However, all such embodiments and adaptations are comprehended by the present invention.

Further, the check valves employed in embodiments in accordance with the invention may be other than the ball and socket configuration shown and described above. They may also be flat plate or reed designs, as are well known in the valve arts. All such valves are comprehended by the invention, provided

What is claimed is:

1. A camshaft phaser system for controllably varying the timing of an engine valve actuable by a camshaft in an internal combustion engine, the phaser timing being controllably varied by cyclic torque oscillation of the camshaft, comprising:

a) a camshaft phaser having a stator and a rotor and at least one advance chamber and at least one retard chamber disposed therebetween;

b) check valve means in said phaser for controlling communication of a hydraulic fluid in first and second opposing directions between said advance chamber and said retard chamber;

c) a piston means for controllably opening and closing said check valve means, said piston means including first and second ramps and a piston bore; and d) a flow path for said hydraulic fluid between said advance chamber and said retard chamber, wherein said check valve means includes first and second check valves disposed in opposite orientations in said flow path, wherein said first and second check valves extend into said piston bore for selective engagement by said first and second ramps, respectively, during actuation of said piston; and wherein said first and second ramps are spaced axially such that said first and second check valves may be closed simultaneously, effectively locking said rotor in holding position.

* * * * *